United States Patent [19]

Stangel et al.

[11] 4,451,831

[45] May 29, 1984

[54] CIRCULAR ARRAY SCANNING NETWORK

[75] Inventors: John J. Stangel, Mahopac; John C. Herper, Glen Cove; Carl Rothenberg, North Bellmore, all of N.Y.

[73] Assignee: Sperry Corporation, New York, N.Y.

[21] Appl. No.: 278,252

[22] Filed: Jun. 29, 1981

[51] Int. Cl.[3] ..... H01Q 3/40

[52] U.S. Cl. ..... 343/374

[58] Field of Search ..... 343/853, 854, 100 SA

[56] References Cited

U.S. PATENT DOCUMENTS

| | | | |
|---|---|---|---|
| 3,827,055 | 7/1974 | Bogner et al. | 343/854 |
| 3,839,720 | 10/1974 | Reindel | 343/854 |
| 4,010,474 | 3/1977 | Provencher | 343/854 |

*Primary Examiner*—Eli Lieberman

*Attorney, Agent, or Firm*—Howard P. Terry; Seymour Levine

[57] ABSTRACT

An apparatus and method for scanning a circular array through 360° with tapered aperture illumination function to achieve radiated beams with desired sidelobe levels. A switching matrix selects a predetermined number of active elements from the total number of elements disposed about the circle to form a sub-array. To this sub-array a variable amplitude distribution network is coupled to establish excitations at each active element in accordance with a desired amplitude distribution function.

8 Claims, 8 Drawing Figures

CIRCULAR ARRAY SCANNING NETWORK

BACKGROUND OF THE INVENTION

1. Field of the Invention

The invention relates to circular or cylindrical array antennas and more particularly to antennas circularly scannable over a full 360° extent.

2. Description of the Prior Art

Many radar systems require antennas with narrow azimuthal beamwidths scannable over a full 360°. One method employed in the prior art for satisfying these requirements is to provide an antenna with the desired beam characteristics and mechanically rotate the entire assembly. These are high inertial systems, however, which require considerable driving power and provide limited scan rate capabilities. To overcome the deficiencies of mechanical scan antennas, various electronic systems for circular scanning have been devised. Early prior art electronic circularly scanned systems utilized switching networks to sequentially excite circularly disposed antenna elements with uniform distributions. This arrangement exhibits course step scanning characteristics due to the element switching to effectuate scanning and high radiated sidelobe characteristics due to the uniform illumination. An antenna for circularly scanning a beam electronically that overcomes many of the deficiencies of the early prior art is disclosed in U.S. Pat. No. 3,816,830. In this configuration, an amplitude distribution is established at the output terminals of a divider network and fed therefrom to selected antenna elements via a complex switching network which routes each element of the excited group to the proper output terminal of the divider network to couple the established amplitude distribution across the antenna aperture. This method for providing amplitude tapering lacks versatility, providing only the pre-established distribution. Additionally, the switching network contains a multiplicity of switching tiers, each tier containing a plurality of switching elements. Since each switch is lossy, undesired signal attenuation occurs between the divider network and the radiating elements. The present invention provides an efficient electronic system for establishing selectable aperture distributions over a predetermined number of elements of a circular array and electronically scanning the radiated beam corresponding thereto.

SUMMARY OF THE INVENTION

A preferred scanning array constructed according to the principles of the present invention includes an array of antenna elements circularly disposed with substantially equal angular spacings therebetween. Coupled to these elements is a switching network which operates to select a predetermined number of elements from the array, as for example, one-fourth of the total number, to form a sub-array of successive elements over a given angular extent, as for example, 90°. Also included is a distribution network that distributes the signal energy received at an input port equally between a plurality of output ports. A signal level adjustment network is coupled between the output ports of the uniform distribution network and the input ports of the switching network which adjusts the signal levels coupled to each switch in the switching network in accordance with a desired aperture distribution function. As the switch commutes selected sub-arrays about the circular array, the adjustment of phase shifters included within the level adjusting network tailors the excitation at each element in the sub-array to a level that is in accordance with the desired aperture distribution. In addition, the switching network may be used in conjunction with the level adjustment circuit to effectively remove elements from the contiguous radiating sub-array and to include other elements exterior to this contiguous sub-array, thus creating a density tapered antenna array. Other features in the advantages of the invention will become apparent from the following detailed description.

DESCRIPTION OF THE PREFERRED EMBODIMENTS

Figure 1:
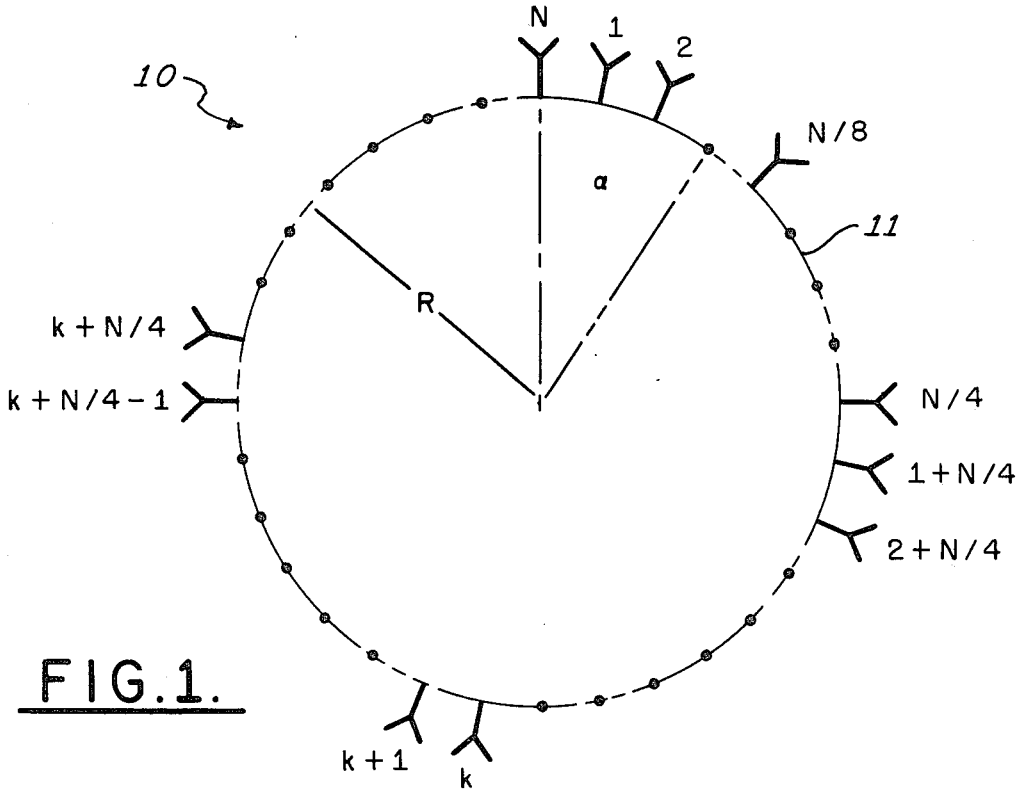
FIG. 1 is an illustration of a circular array of antenna elements.

Referring to FIG. 1, there is shown an array of N circularly disposed antenna elements 1 through N arranged on a circle 10 of radius R with equal angular spacings therebetween. When a sub-array of continously numbered elements, as for example, 1 through N/4 is illuminated with appropriate phasing and a desired amplitude distribution, a beam will be radiated therefrom with a beam peak positioned substantially at the angular location of the center of the excited sub-array. This beam may be scanned by an angle substantially equal to the angular separation of the elements by removing element 1 from the excited sub-array, including element 1+N/4 therein, and adjusting the phase and amplitude distribution across the resulting sub-array to substantially duplicate the appropriate phasing and the desired amplitude distribution. In this manner, a beam may be circularly scanned through a full 360° with angular steps of 360°/N. It should be recognized that a total scan angle of less than 360° permits the removal of an appropriate number of antenna elements from the array.

Figure 2:
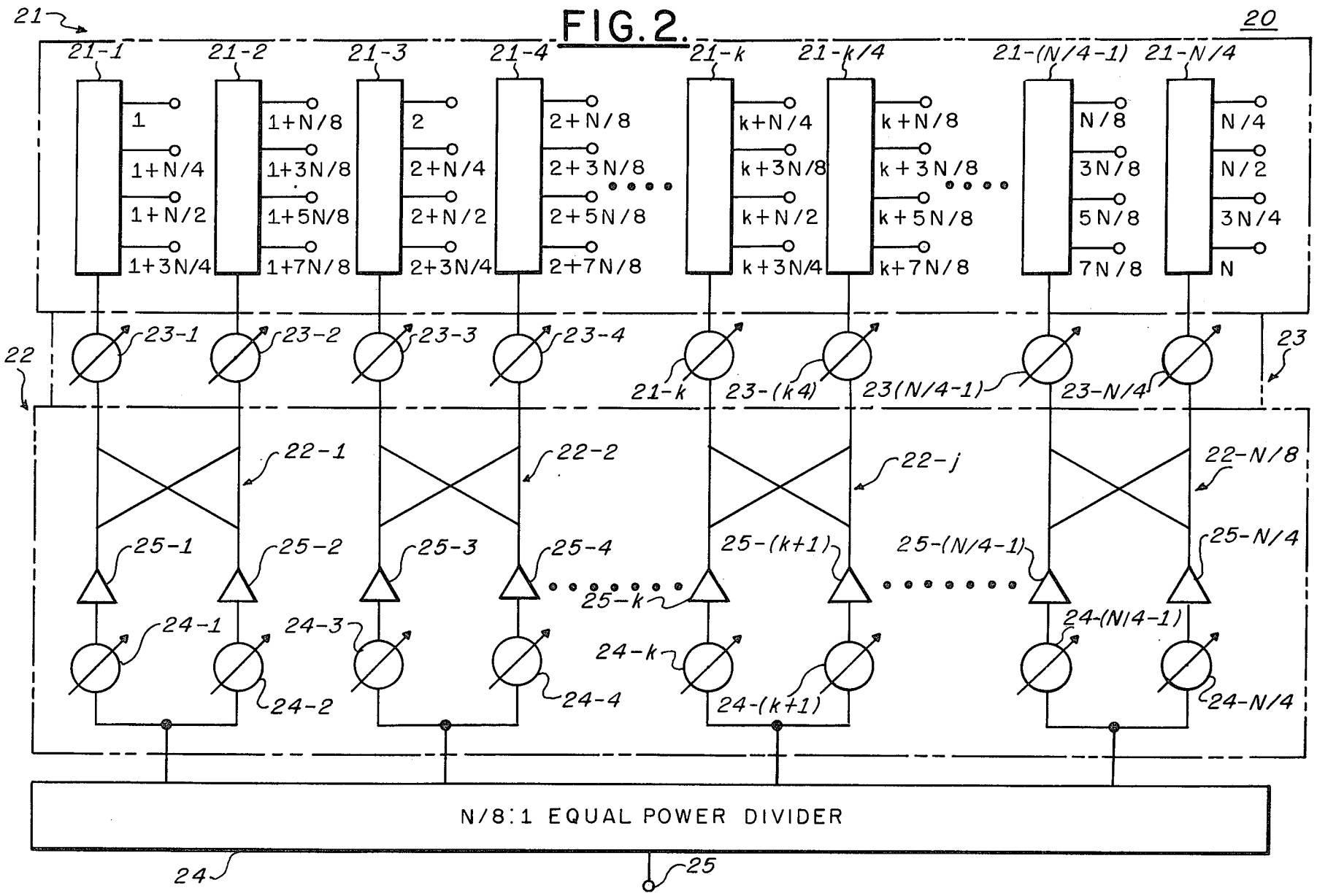
FIG. 2 is a schematic diagram, partially in block form, of an embodiment of the invention.

Referring now to FIG. 2, there is shown a schematic diagram, partially in block form, of a feed network for accomplishing desired element switching, phasing, and excitation for circularly scanning the array of FIG. 1. Feed network 20 may include a switching matrix 21 having N output ports each of which is coupled to a corresponding element in the circular array 10, a variable power divider 22, a phasing circuit 23 coupled between the variable power divider 22 and the switching matrix 21, and an equal power divider 24 coupled between the variable power divider 22, and the system input port 25. Switching matrix 21 may be configured to comprise a single pole-multiple throw switch for each active element in the desired sub-array, the number of throws in each switch being equal to the reciprocal of the fractional extent of the sub-array about the circle 11. Thus, N/2 switches, each with a single pole double throw configuration, are required for a sub-array of contiguous elements covering 180° about the circle 11, and N/3 switches, each of a single pole triple throw configuration are required for a sub-array extending over a 120° sector of the circle 11. In FIG. 2, N/4 single pole-four throw switches are shown which provides the sub-arrays that cover a 90° sector about the circle 11. These switches 21-1 through 21-N/4 are arranged in the switching matrix such that alternate switches have their uppermost positions coupled to adjacent elements in the circular array 10 and adjacent switches have their uppermost position coupled to an element half a sub-array away from the uppermost position of the preceding switch. Subsequent positions of each of the switches 21-1 through 21-N/4 are coupled to elements on the array 10 in N/4 increments. Phase control at each of the excited elements for beam collimation may be achieved by coupling 360° phase shifters 23-1 through 23-N/4 comprising phase shift network 23 to the input ports corresponding switches 21-1 through 21-N/4. If the input ports of the phase shifters 23-1 through 23-N/4 are connected directly to a N/4:1 equal power divider, a substantially uniformly illuminated beam could be scanned around the circular array.

Assume an initial setting of the switches 21-1 through 21-N/4 to be in the upper position, thus initially including elements 1 through N/4 in the sub-arry. With the switches so set, phase shifters 23-1 through 23-N/4 are adjusted to provide an equal phase front in the plane tangent to the circle 11 at the center of the sub-array, i.e., at the central element for an odd numbered sub-array or at the point midway between elements N/8 and N/8+1 for an even numbered sub-array. To move the beam by an angle corresponding to one inter-element angle, switch 21-1 is reset to remove element 1 from the sub-array and replace it with element 1+N/4 and phase shifters 23-1 through 23-N/4 are readjusted for beam collimation in the direction corresponding to the mid-point of the resulting sub-array. The beam may be scanned by an additional inter-element angle by resetting switch 21-3 to remove element 2 from the sub-array and replace it with element 2+N/4. If this drop-add element switching is continued for all N elements, it should be apparent that a radiated beam will be scanned through a full 360° with N discrete beams separated by 360/N degrees. Other beam pointing directions may be obtained between each of these N switchable positions by selecting one and adjusting the phase shifters for collimation to desired directions between adjacent switchable settings.

As described above, each sub-array is uniformly illuminated, causing the radiated beam to exhibit relatively high sidelobes. This deficiency may be rectified by establishing a variable signal coupling coefficient through the inclusion of a variable power divider 22 between the equal power divider 24 and the phase shift network 23. The variable power divider 22 may comprise a plurality of four port 3 dB couplers 22-1 through 22-N/8. Each input port of the 3 dB coupler is coupled to a variable phase shift element of the plurality of phase shift elements 24-1 through 24-N/4, while each pair of variable phase shifters, as for example 24-1 and 24-2 are coupled to the input ports of 3 dB coupler 22-1, couple to a common output port of the N/8:1 equal power divider 24.

Figure 3:
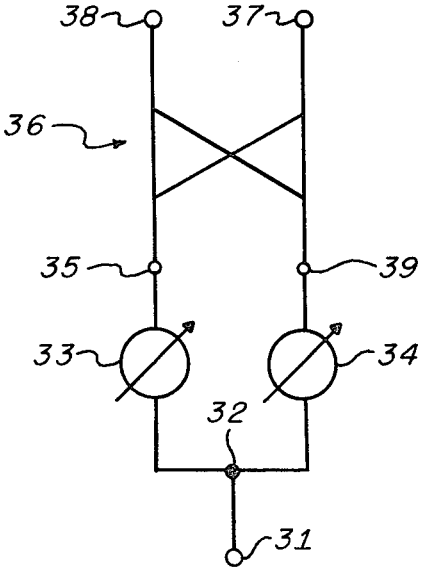
FIG. 3 is a schematic diagram of a two port to one port variable power divider.

Refer now to FIG. 3, there is shown a schematic diagram of a 3 dB coupler-phase shifter combination included in the variable power divider 22. Consider a signal of energy level $V^2$ coupled to the input port 31. This signal splits equally at the T junction 32 to couple signals of equal level to the phase shifters 33 and 34. The phase shifted signal from phase shifter 33 is coupled to an input port 35 of 3 dB coupler 36 wherefrom it couples with equal amplitude to the output ports 37 and 38, but in-phase quadrature, the signal at port 38 being in-phase with the signal at port 35 while the signal at port 37 is advanced by 90°. Similarly, the phase shifted signals from phase shifter 34 are coupled via input port 39 to the output ports 37 and 38 with equal amplitude but in-phase quadrature, the signal at port 37 being in-phase with the signal at port 39 while the signal at port 38 is advanced by 90°. Couplers exhibiting these properties are well known in the art. The signals coupled through phase shifters 33 and 34 combine at the output ports 37 and 38 to provide signals, $V_{37}$ and $V_{38}$ respectively, having phase and amplitude dependence on the differential phase shift $\Delta\phi=\phi_1-\phi_2$, where $\phi_1$ is the phase setting of phase shifter 33 and $\phi_2$ is the phase setting of phase shifter 34. The signals $V_{37}$ and $V_{38}$ being expressable as:

$$V_{37}=\frac{V}{\sqrt{2}}\left[\cos\frac{\Delta\phi}{2}-\sin\frac{\Delta\phi}{2}\right]\exp\left[j\frac{(90+\phi_1+\phi_2)}{2}\right] \quad (1)$$

$$V_{38}=\frac{V}{\sqrt{2}}\left[\cos\frac{\Delta\phi}{2}+\sin\frac{\Delta\phi}{2}\right]\exp\left[j\frac{(90+\phi_1+\phi_2)}{2}\right] \quad (2)$$

and the power levels $P_{37}$ and $P_{38}$ being expressable as:

$$P_{37}=\frac{V^2}{2}[1-\sin\Delta\phi] \quad (3)$$

$$P_{38}=\frac{V^2}{2}[1+\sin\Delta\phi] \quad (4)$$

It is evident from equations (3) and (4) that a variation in-phase shift from 0° to 90° for both $\phi_1$ and $\phi_2$ permits the signal energy to be distributed between the output ports 37 and 38 with any desired proportionality.

It will be recognized by those skilled in the art that 3 dB couplers of the "rat race" or magic "T" type will perform in a manner similar to that above-described. It should also be recognized that the above design permits power amplifiers to be efficiently incorporated therein. As shown in FIG. 2, power amplifiers 25-1 through 25-N/4 may be inserted between the 3 dB couplers 22-1 through 22-N/8 and the 24-1 through 24-N/4 phase shifters. Losses incurred behind the amplifiers including the losses in the phase shifters and the equal power divider 24 could be regained by these amplifiers. It should also be recognized that this positioning of the amplifiers is the furthest point in the switching network where the amplifiers may provide equal power output and still permit the network to produce a tapered illumination.

Figure 4:
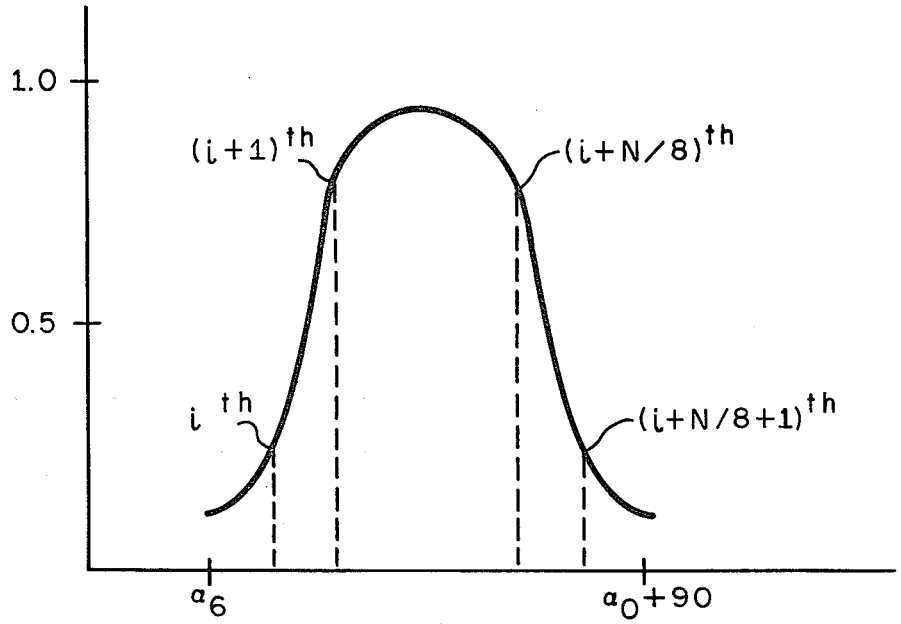
FIG. 4 is a graphical representation of an aperture distribution achievable with two port to one port variable power dividers.

Refer again to FIG. 2, where it will be observed that the output ports of each 3 dB coupler couple via switches in the switching matrix 21 to elements in the array that are an eighth of the circumference apart, that is, two elements spaced apart by half a sub-array. This network, therefore, has the ability to weight the power coupled to each element while maintaining constant total power to pairs of elements spaced apart by half a sub-array. This flexibility is sufficient to generate a good sidelobe illumination taper. In FIG. 4 is shown a power distribution for a sub-array extending from a given angular position $\alpha_0$ on the circle 11 through a 90° sector to $\alpha_0+90°$. Examination of this figure indicates that the total power coupled to the $i^{th}$ element and the $(i+N/8)^{th}$ element with which it is paired equals 1, as does the total power coupled to the pairs $(i+1)^{th}$ and $(i+N/8+1)^{th}$. When 25% of the circular array is used for beam formation, the constant total power restraint on the paired coupled elements, however, implies a restriction on the illumination amplitude function $f(\alpha)$ to real functions satisfying the equation $$f^2(\alpha) = \tfrac{1}{2} + \sum_{n=1}^{\infty} a_n \cos 4(2n-1)\alpha \tag{5}$$

where $\alpha$ is the angular coordinate of the element within the limits $-\pi/4 \leqq \alpha \leqq \pi 4$.

Additionally, since the total power coupled to elements separated by a half a sub-array must equal one, the maximum taper that can be achieved at a point midway between the center of the sub-array and its edge is 3 dB. These constraints limit the illumination functions which may be achieved. As, for example, illumination functions for maximum sidelobe levels on the order of 25 dB are achievable, but illumination functions for maximum sidelobe levels on the order of 30 dB are highly unlikely when the variable power divider of FIG. 3 is utilized to establish commonly used cosine and Taylor distributions.

Figure 5:
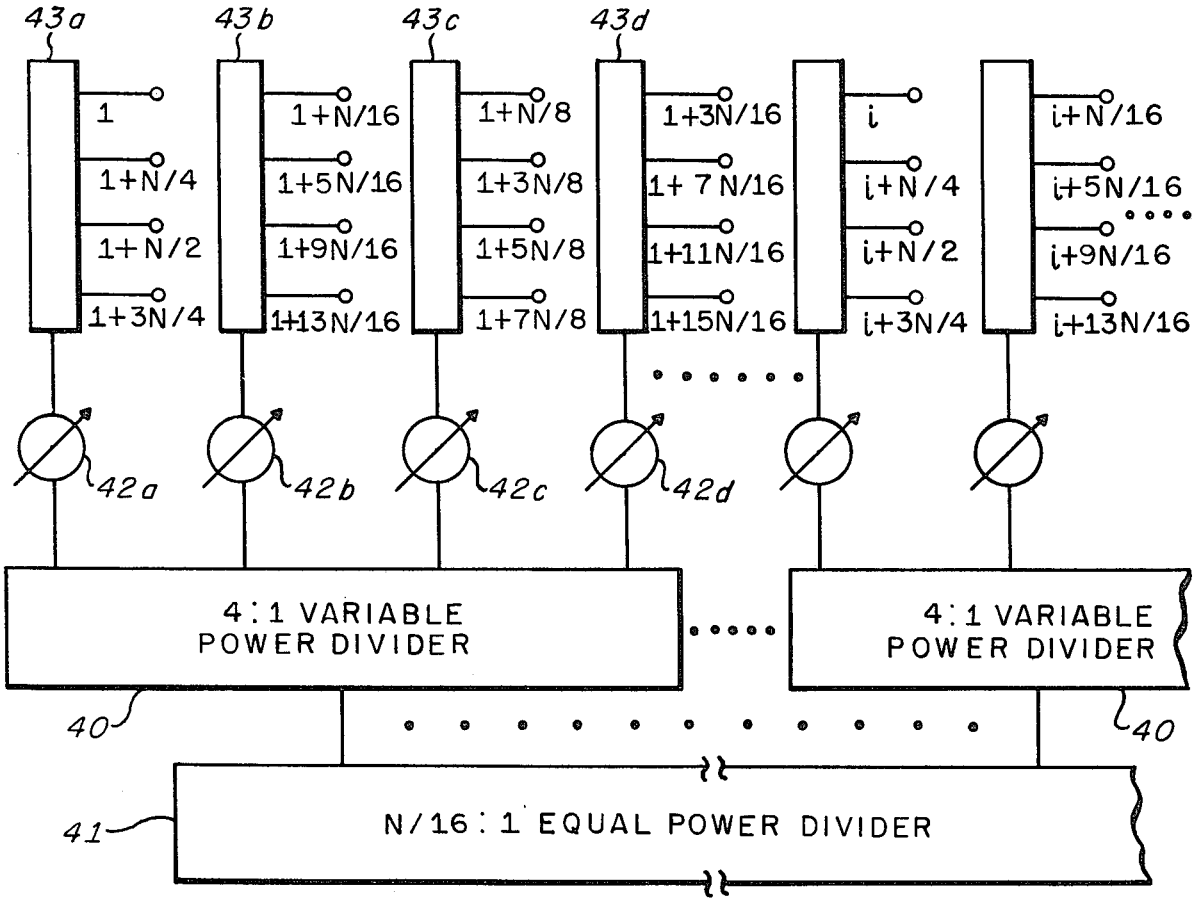
FIG. 5 is a block diagram illustrating an embodiment of the invention utilizing four port to one port variable power dividers.

Greater power distribution flexibility may be achieved with the N/16:1 equal power divider followed by the 4:1 electronically variable power dividers arrangement shown in FIG. 5. The input ports of 4:1 variable power dividers 40 are coupled to the output ports of a N/16:1 equal power divider 41 while the four output ports of each are coupled via variable phase shifters to single pole four throw switches, as for example, phase shifters 42*a* through 42*d* and switches 43*a* through 43*d*. The first tier of output ports of adjacent switches 43*a* through 43*d* are successively coupled to elements of the array spaced N/16 apart. While subsequent ports on each switch are coupled to elements a quarter of array from the element coupled to the preceding output port on that switch. Thus, the first tier of output ports of the switches 43*a* through 43*d* are respectively coupled to elements 1, 1+N/16, 1+N/8, and 1+3N/16. Each output port on each switch is coupled to an element removed from the element coupled to the preceding output terminal by one-fourth the circumference of the array, as for example, switch 43*b* has its upper tier output port coupled to element 1+N/16 and subsequent output ports coupled to 1+5N/16, 1+9N/16, and 1+13N/16. With this arrangement, N/16, 4:1 variable power dividers and groupings of four single pole four throw switches are required.

Figure 6:
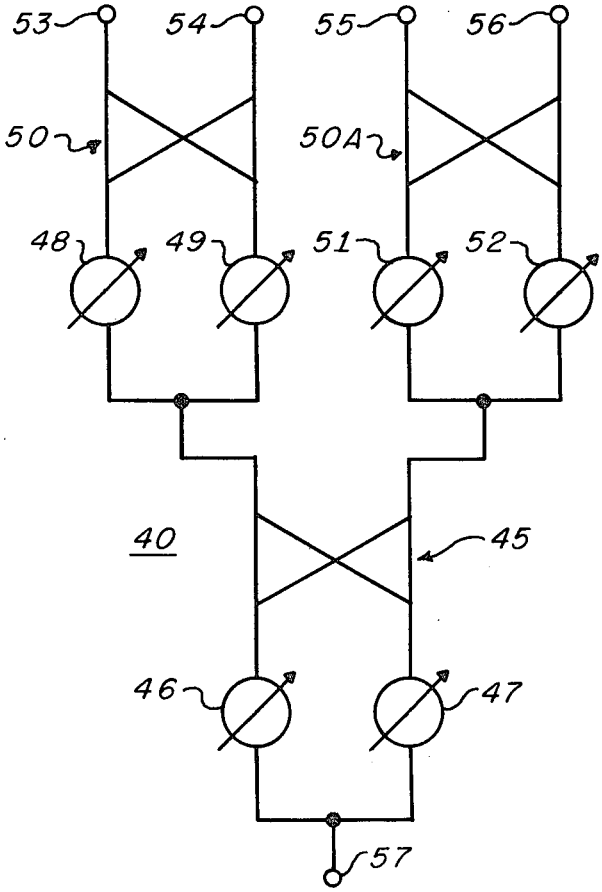
FIG. 6 is a schematic diagram of a four port to one port variable power divider.

A suitable configuration for the 4:1 variable power divider 40 comprising three 3 dB couplers and six variable phase shifters is shown in FIG. 6. A first 3 dB coupler 45 has its input terminals coupled to one output terminal of the N/16:1 equal power divider 41 via variable phase shifters 46 and 47 and has one output terminal coupled, via variable phase shifters 48 and 49, to the input terminals of a second 3 dB coupler 50, while a second output terminal of 3 dB coupler 45 is coupled, via variable phase shifters 51 and 52, to the input terminals of a third 3 dB coupler 50A. Designating the differential phase shift between variable phase shifters 46 and 47 as $\Delta\phi=\phi_{47}-\phi_{46}$, differential phase shift between variable phase shifters 48 and 49 as $\Delta\phi_1=\phi_{49}-\phi_{48}$ and the differential phase shift between variable phase shifters 51 and 52 as $\Delta\phi_2=\phi_{52}-\phi_{51}$, it should be apparent to those skilled in the art that the output signal $V_{ij}$ and power $P_{ij}$ levels at the ports 53 through 56 for a signal with an energy level $V_o^2$ incident to the input port 57 are:

$$V_{53} = \frac{V_o}{2}\left[\cos\left(\frac{\Delta\phi - \Delta\phi_1}{2}\right) + \sin\left(\frac{\Delta\phi + \Delta\phi_1}{2}\right)\right]\exp[j\psi_1]$$

$$V_{54} = \frac{V_o}{2}\left[\cos\left(\frac{\Delta\phi + \Delta\phi_1}{2}\right) + \sin\left(\frac{\Delta\phi - \Delta\phi_1}{2}\right)\right]\exp[j\psi_1]$$

$$V_{55} = \frac{V_o}{2}\left[\cos\left(\frac{\Delta\phi + \Delta\phi_2}{2}\right) - \sin\left(\frac{\Delta\phi - \Delta\phi_2}{2}\right)\right]\exp[j\psi_2]$$

$$V_{56} = \frac{V_o}{2}\left[\cos\left(\frac{\Delta\phi - \Delta\phi_2}{2}\right) - \sin\left(\frac{\Delta\phi + \Delta\phi_2}{2}\right)\right]\exp[j\psi_2]$$

and $$P_{53} = \frac{V_o^2}{4}[1 + \sin\Delta\phi\sin\Delta\phi_1 + \sin\Delta\phi + \sin\Delta\phi_1]$$

$$P_{54} = \frac{V_o^2}{4}[1 - \sin\Delta\phi\sin\Delta\phi_1 + \sin\Delta\phi - \sin\Delta\phi_1]$$

$$P_{55} = \frac{V_o^2}{4}[1 - \sin\Delta\phi\sin\Delta\phi_2 - \sin\Delta\phi + \sin\Delta\phi_2]$$

$$P_{56} = \frac{V_o^2}{4}[1 + \sin\Delta\phi\sin\Delta\phi_2 - \sin\Delta\phi - \sin\Delta\phi_2]$$

where:

$$\Omega_1=90+\phi_{46}+\phi_{47}+\phi_{48}+\phi_{49}$$

$$\Omega=90+\phi_{46}+\phi_{47}+\phi_{51}+\phi_{52}.$$

From these equations, it is apparent that the coupling coefficients between the equal power divider 41 and each of the sub-array elements are continuously variable between 0 and 1; that the power available for distribution may be apportioned to the four elements in the sub-array in any desirable manner; and that a significant increase in power distribution flexibility over that of the 2:1 variable power divider is realized.

If i designates an element to which the first single throw four pole switch of a group of four switches is coupled, the energy appearing at the $i^{th}$ element, $(i+N/16)^{th}$ element, the $(i+N/8)^{th}$ element, and the $(i+3N/16)^{th}$ element originates at the same output port of the N/16:1 equal power divider 41 and routed through the same variable 4:1 power divider 40. Thus, with four watts coupled to the variable power divider 40 from the output terminal of the equal power divider 41, the sum of the powers at the above-identified four elements is equal to four watt, i.e., $P(i)+P(i+N/16)+P(i+N/8)+P(i+3N/16)=4$ for all i's.

Figure 7:
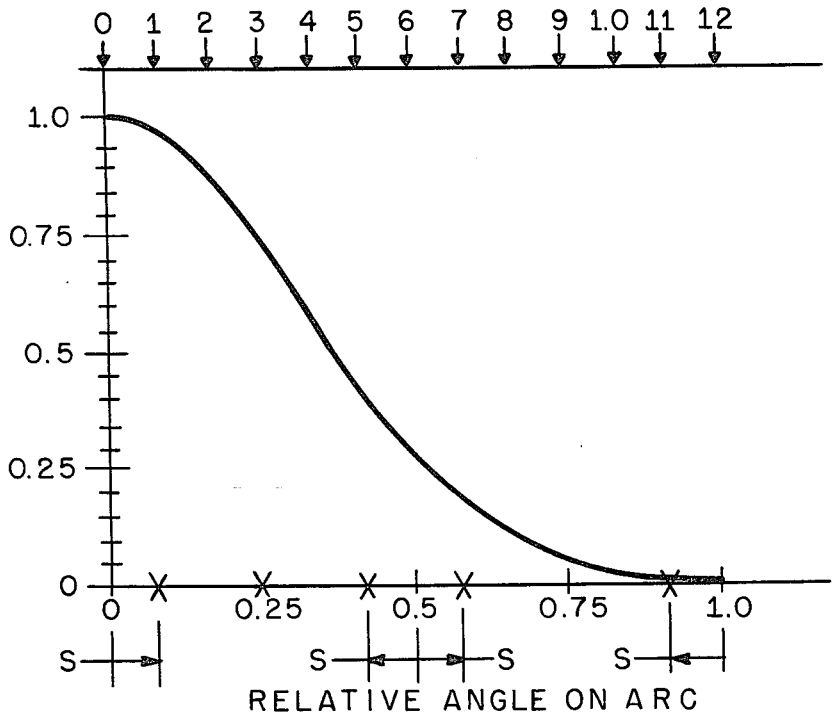
FIG. 7 is a graphical representation of an aperture distribution achievable with four port to one port variable power dividers.

A half arc 40 dB Taylor illumination projected from a linear aperture to the circular contour of the array, assuming that a ±45° sector of the array is excited, is plotted in FIG. 7. Good agreement between a function synthesized with the 4:1 variable coupler of FIG. 7 and this Taylor was observed, indicating that illuminations compatible with 40 dB sidelobes can be achieved with this switching network. Numerical excitation values corresponding to the desired illumination are tabulated in Table 1 for the twelve equidistant points on the half arc indicated in FIG. 7.

TABLE 1

| Point CN ARC (n) | Relative Power ($P_n$) |
|---|---|
| 0 | 1.000 |
| 1 | 0.978 |
| 2 | 0.886 |
| 3 | 0.742 |
| 4 | 0.576 |
| 5 | 0.424 |
| 6 | 0.293 |
| 7 | 0.179 |
| 8 | 0.103 |
| 9 | 0.056 |
| 10 | 0.031 |
| 11 | 0.016 |
| 12 | 0.011 |

Those skilled in the art will recognize that, for the element coupling as indicated in FIG. 5, an element a distance S from the 0.00 coordinate is coupled through the same variable power divider as an element a distance S from the 0.5 coordinate, as are the elements a distance S, respectively, from the −1.0 and −0.5 coordinates (not shown), the two power dividers forming a 4:1 variable power divider. The latter excitations, however, because of the symmetry of the desired illumination, are the same as those of the elements removed a distance −S from the 1.0 and 0.5 coordinates. These four points are indicated as 61, 62, 63 and 64, respectively, on the horizontal axis in FIG. 7. Thus, the value of the illumination at various points are interrelated such that if P(x) is the illumination in relative power for $-1 \leqq x \leqq 1$, then $P(S)+P(0.5+S)+P(0.5-S)+P(1.0-S)=\text{constant}$. To check the conformance of the functions tabulated above, consider:

$$A=P_0+2P_6+P_{12}=1.597$$

$$B=P_1+P_5+P_7+P_{11}=1.597$$

$$C=P_2+P_4+P_8+P_{10}=1.596$$

$$D=2P_3+2P_9=1.596$$

where the subscripts refer to the tabulated numerical values. Since the sums are equal within three place accuracy, the constraints of the switching network is compatible with the above illumination functions.

Figure 8:
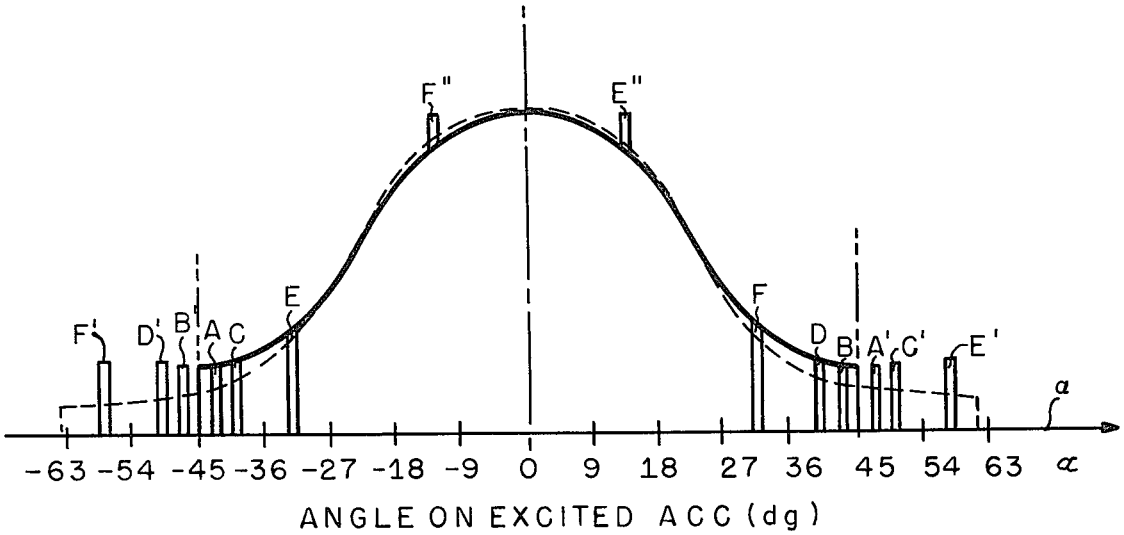
FIG. 8 is a graphical illustration useful for explaining density tapering.

Greater flexibility in realizing the tapered illumination function than that achievable with the methods above-described may be realized by applying density tapering techniques. Basically, density (or space) tapering involves interspersing inactive or unexcited elements within the aperture of an array to generate an effective illumination taper via amplitude averaging. This is illustrated in FIG. 8. The solid curve, a smoothly varying function truncated at a ±45°, is a typical power illumination function that can be attained by coupling to elements at positions A, B, C, D, E and F through the element coupling system of FIG. 2. Since the element at position A′ is 90° from the element at position A, it is coupled to the same single pole four throw switch (SP4T). Therefore, throwing this switch to select the element at position A′ removes the element at position A from the array and replaces it with the element at position A′. Similarly, the elements at B and B′, the positions symmetric to A and A′ about X=0, are also coupled to a common SP4T switch. Consequently, throwing this switch to select the element at B′ removes the element at B and replaces it with the element at B′. In a similar manner, the elements at locations C and C′ and D and D′ could be switched to further modify the illumination. These operations cause a symmetric density taper near the edge of the aperture which alters the effective edge taper of the illumination function and reduces the sidelobes beyond that which could otherwise be achieved with the element excitation represented by the solid curve of FIG. 8.

Additional aperture illumination flexibility can be achieved by utilizing the variable power divider 22 to modify the excitations in the resulting array after switching. Consider the element at position E in FIG. 8. This element and the element at E′ are coupled to a common SP4T switch. The energy coupled to these elements, however, is shared with the energy coupled to the element at position E″ (45° away on the array arc) through the common variable power divider. Hence, switching to the element at position E′ and adjusting the power coupled thereto, not only affects density tapering but causes a change in the power split that effects the excitation of E″. The effect of similar switching and excitation adjustment involving elements at corresponding symmetric positions F, F′, and F″ is also illustrated in FIG. 8. The net result of these switchings and power adjustments is to change the effective aperture illumination function to one that it is characteristic of lower sidelobe ratios indicated by the dashed curve in FIG. 8. This dashed curve is representative of the average amplitude excitation in the resulting density tapered power adjusted array.

The simplest way of steering a circular array is achieved by eliminating the variable power divider 22 while maintaining the equal power divider 24, 360° phase shifters 23, and the SP4T switches 21. Element sequencing may then be achieved by the SP4T switches 24 while the phase shifters provide collimation. This simplest approach, however, provides only uniform amplitude illumination with its characteristic 13 dB sidelobes as previously discussed. The density tapering technique, described above, substantially eliminates this deficiency, making it possible to achieve lower sidelobe levels without additional RF hardware.

It should be recognized that the system elements described, with the exception of the amplifiers 25-1 through 25-N/4, are linear and bilateral. Consequently, though the systems were basically discussed above as transmitting systems, the description with the inclusion of a transmit-receive amplifier circuit, well known in the art, is also applicable to receiving systems.

From the above it should be apparent to those skilled in the art that the invention, in addition to reducing the complexity of circularly scanned arrays, provides a capability not achievable with prior art circular scanning systems, viz the ability to electronically control the illumination taper, hence the features of the radiation pattern with the same hardware used to scan the beam. Thus by properly setting the variable power divider controls, the array, when used in a radar system, could produce a high efficiency beam characteristic of uniform illumination in one scan direction to achieve maximum detection range in a clear environment and a lower efficiency, lower sidelobe beam in another direction for jamming suppression. The invention thus permits adaptive control of the antenna pattern parameters (e.g. gain, sidelobes, beamwidth, null position, etc.) to optimize the performance of the associated electronic system to existing operational conditions.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An antenna system for scanning a beam through selected spatial positions comprising:

an array of arcuately disposed antenna elements;

switch means coupled to said array for selecting elements therefrom to form selected sub-arrays;

means responsive to signals coupled to first terminal means thereof for providing substantially uniformly distributed signals to second terminal means thereof; and variable distribution means having a plurality of input ports coupled to said second terminal means of said uniform distribution means and a multiplicity if ouput ports coupled to said switch means for varying signal coupling coefficients between said selected elements and said uniform distribution means, thereby establishing selectable aperture distributions for said sub-arrays, said variable distribution means including:

first coupler means having first and second input means coupled to said plurality of input ports and having first and second output means coupled to said switch means for coupling signals incident to said first input means thereof to said first and second output means with a predetermined amplitude ratio and a predetermined phase difference therebetween and for coupling signals incident to said second input means thereof to said first and second output means with said predetermined amplitude ratio and a phase difference therebetween that is opposite said predetermined phase difference; and first and second variable phase shift means having output ports coupled respectively to said first and second input means of said first coupler means and input ports coupled to said uniform distribution means for providing phase shifts to signals incident to said first and second input means of said coupler means to aportion said incident signal between said first and second output means of said coupler means in accordance with desired amplitude ratios.

2. An antenna system in accordance with claim 1 further including phase shift means coupled between said variable distribution means and said switch means for phase shifting signals in accordance with beam collimation requirements.

3. An antenna system in accordance with claim 1 where said coupler means are 3 dB couplers.

4. An antenna system in accordance with claim 1 further including amplifier means coupled between said first phase shift means and said first and second input means of said coupler means.

5. An antenna system for beam scanning in accordance with claim 1 wherein said variable distribution means further includes:

second coupler means having first and second output means coupled to said switch means for coupling signals incident to a first input means thereof between said first and second output means thereof with a predetermined amplitude ratio and a predetermined phase difference therebetween and for coupling signals incident to second input means thereof between said first and second output means thereof with said predetermined amplitude ratio and a phase difference therebetween that is opposite said predetermined phase difference;

second phase shift means coupled between said first and second input means of said second coupler means and said first means of said first coupler means for phase shifting signals incident to said first and second input means of said second coupler means from said first output means of said first coupler means;

third coupler means having first and second output means coupled to said switch means for coupling signals incident to a first input means thereof between said first and second output means thereof with a predetermined amplitude ratio and a predetermined phase difference therebetween and for coupling signals incident to a second input means thereof with said predetermined amplitude ratio and phase difference therebetween that is opposite said predetermined phase difference; and third phase shift means coupled between said first and second input means of said third coupler means and said second output means of said first coupler means for phase shifting signals incident to said first and second input means of said third coupler means from said second output port of said first coupler means whereby signals incident to said first and second input menas of said first coupler means via said first phase shift means are proportioned between said first and second output means of said second and third coupler means in accordance with phase differences between said first and second input means of said first, second and third coupler means established respectively by said first, second and third phase shift means.

6. An antenna system in accordance with claim 5 wherein said first, second and third coupler means are 3 dB couplers.

7. An antenna system in accordance with claim 5 further including amplifier means coupler between said first phase shift means and said first and second input means of said first coupler means for amplifying signals incident to said first and second input means of said first coupler means from said first phase shift means.

8. An antenna system in accordance with claim 5 further including phase shift means coupled between said variable distribution means and said switch means for phase shifting signals in accordance with beam collimation requirements.

* * * * *